United States Patent [19]

Watanabe et al.

[11] 4,260,343

[45] Apr. 7, 1981

[54] VANE COMPRESSOR

[75] Inventors: Risaburo Watanabe; Masami Ohtani; Naoki Hashizume, all of Higashimatsuyama, Japan

[73] Assignee: Robert Bosch GmbH, Stuttgart, Fed. Rep. of Germany

[21] Appl. No.: 7,257

[22] Filed: Jan. 29, 1979

[51] Int. Cl.[3] ..... F04C 2/00

[52] U.S. Cl. ..... 418/269

[58] Field of Search ..... 418/82, 93, 267–269

[56] References Cited

U.S. PATENT DOCUMENTS

| | | | |
|---|---|---|---|
| 2,949,860 | 8/1960 | Stockton | 418/269 |
| 3,329,067 | 7/1967 | Rosaen | 418/268 |
| 3,852,003 | 12/1974 | Adalbert et al. | 418/93 |
| 3,994,641 | 11/1976 | Southard | 418/93 |

*Primary Examiner*—Herbert Goldstein
*Attorney, Agent, or Firm*—Michael J. Striker

[57] ABSTRACT

A vane compressor includes a hollow stator, and a rotor which is received in the stator for rotation about an axis. The rotor is provided with a plurality of throughgoing passages which extend radially and outwardly relative to the axis. Each passage receives a vane which has an outer end face directed towards an inner circumference of the stator and an inner end face directed away from the inner circumference of the stator. The vanes are shiftable radially in the respective passages relative to the axis. A pressure medium is supplied under a first pressure to the inner end faces of the vanes to urge the same radially outwardly for engagement of the outer end faces with the inner circumference of the stator. When the rotor is rotated, the vanes are subjected to an additional second pressure resulting from centrifugal force. The second pressure additionally urges the vanes against the inner circumference of the stator. The first and second pressures together constitute a cumulative force which above a predetermined level causes undesired frictional losses at the interfaces between the outer end faces of the vanes and the inner circumference of the stator. An arrangement is provided to decrease the cumulative pressure to the predetermined level to thereby eliminate the undesired frictional losses.

13 Claims, 3 Drawing Figures

FIG. 1
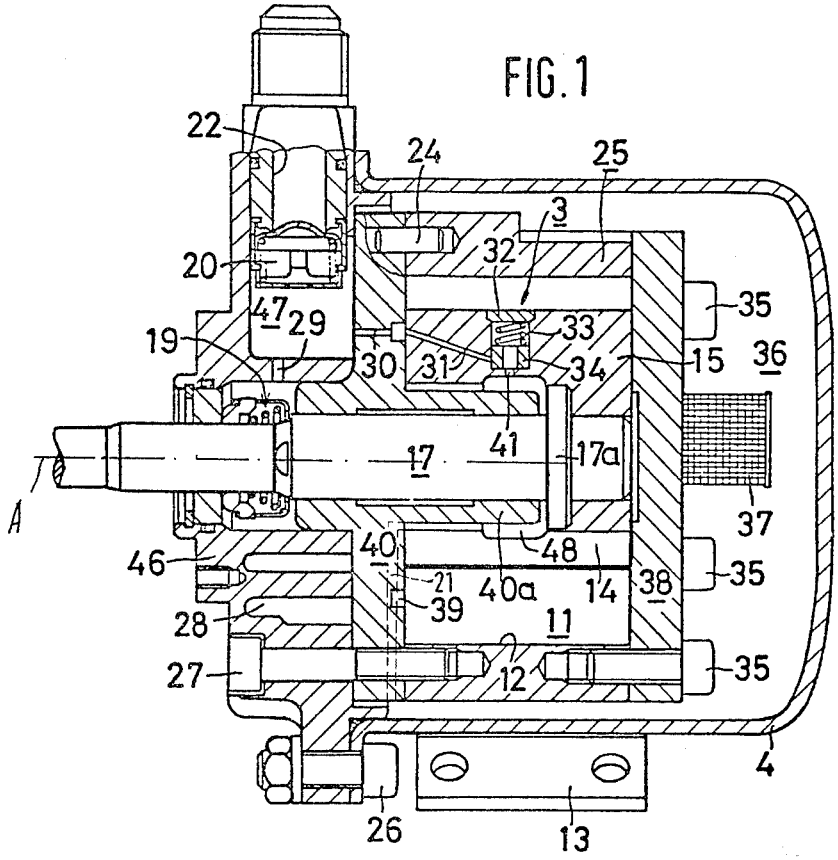
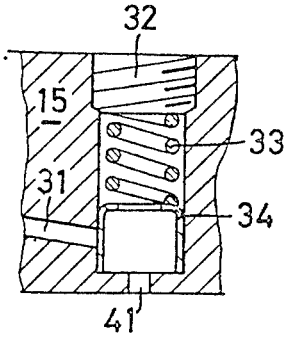
FIG. 3

VANE COMPRESSOR

BACKGROUND OF THE INVENTION

The present invention relates to a compressor.

More particularly, the present invention concerns a vane compressor.

It is known in the prior art to provide a vane compressor with a rotor rotatably mounted in a stator. The rotor has a plurality of throughgoing passages which extend radially and outwardly relative to an axis of the rotor. Each passage receives a vane which has an outer face directed towards an inner circumference of the stator and an inner face which is directed away from the inner circumference of the stator. The vanes are shiftable radially in the respective passages relative to the axis. A pressure medium is supplied under a first pressure to the inner end faces of the vanes to thereby urge the latter radially outwardly relative to the axis of the rotor for engagement of the outer end faces of the vanes with the inner circumference of the stator. When the rotor rotates the vanes are subjected to an additional second pressure resulting from centrifugal force. The second pressure additionally urges the vanes against the inner circumference of the stator. The first and second pressures together constitute a cummulative pressure which when above a predetermined level causes undesired frictional losses at the interfaces between the outer ends of the vanes and the inner circumference of the stator.

SUMMARY OF THE INVENTION

It is a general object of the present invention to avoid the disadvantages of the prior art vane compressors.

More particularly, it is an object of the present invention to provide such a vane compressor which does not cause any undesired frictional losses between the vanes and the inner circumference of the stator even when the rotor rotates with a high rotational speed.

Another object of the present invention is to provide a vane compressor with an arrangement to decrease the pressure onto the vanes when the rotational speed exceeds a predetermined level to thereby maintain the cumulative radial force urging the vanes into engagement with the inner circumference of the stator on such a level as to avoid any frictional losses between the vanes and the inner circumference of the stator.

Still another object of the present invention is to release a corresponding amount of a pressure medium from the interior of the rotor when the rotational speed of the same increases, to thereby maintain the cumulative radial force, urging the vanes into engagement with the inner circumference of the stator, at a predetermined level so as to avoid any frictional losses between the vanes and the inner circumference of the stator.

In pursuance of these objects and others which will become apparent hereafter, one feature of the present invention resides in providing a hollow stator with a rotor for rotation about an axis. The rotor is provided with a plurality of throughgoing passages which extend radially and outwardly relative to said axis. Each passage receives a vane which has an outer end face directed towards an inner circumference of the stator and an inner end face directed away from said inner circumference of said stator. The vanes are shiftable radially, in the respective passages relative to said axis. There are further provided means for supplying pressure medium under a first pressure to the inner end faces of said vanes to thereby urge the latter radially outwardly relative to said axis for engagement of said outer end faces with said inner circumference of the stator. The rotor is rotated about said axis whereby the vanes are subjected to an additional second pressure which results from centrifugal force. The second pressure additionally urges the vanes against the inner circumference of the stator. The first and second pressures together constitute a cumulative pressure which when above a predetermined pressure level causes undesired frictional losses at the interfaces between the outer end faces of said vanes and the inner circumference of the stator.

One of the main advantageous features of the present invention resides in providing means for decreasing said cumulative pressure to said predetermined level so as to eliminate said undesired frictional losses.

The novel features which are considered to be characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a longitudinal section of a vane compressor in accordance with the present invention;

FIG. 3 is an enlarged view of a portion of another embodiment of the vane compressor.

DESCRIPTION OF THE PREFERRED EMBODIMENTS

Figure 2:
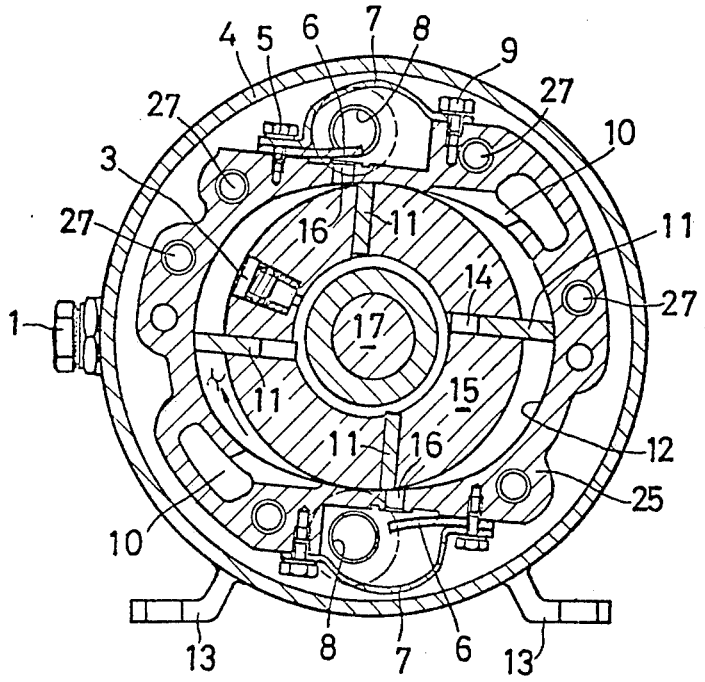
FIG. 2 is a sectional view of the vane compressor.

Referring now to the drawings and first to FIGS. 1 and 2 thereof, it may be seen that the reference 25 designates a cylindrical stator which has a cylindrical interior 12. The both end openings of the stator 25 are closed by end face plates 38 and 40, respectively. The plates 38 and 40 are rigidly fixed (i.e. screwed on) on the end faces of the stator 25 so as to axially limit the interior 12 thereof. A rotor 15 is mounted in the interior 12 of the stator 25 for rotation relative thereto. The rotor 15 includes a circular cylindrical casing which sealingly engages the inner circumference of the stator 25 along two diagonally oppositely located lines of the inner circumference of the casing. Between the outer circumference of the rotor 15 and the cylindrical inner circumference of the stator 25 there are located two opposite crescent-shaped working chambers.

The central hole of the rotor 15 receives the end portion of a shaft 17 which is supported on two sliding bearings which are located in a hollow supporting tube of a left end face plate 40. The shaft 17 extends with its portion outwardly away from the plate 40 and is sealed by a conventional shaft sealing arrangement 19. The stator 25 with the end face plates 38 and 40 is encompassed by a cup-shaped closure 4, which is mounted on a base 46 by means of screws 26. The base 46 is in its turn connected to the stator 25 by means of screws 27.

The base 46 is provided with a low pressure chamber 47 which has a connecting pipe 22 having a suction valve 20. The low pressure chamber 47 also is connected to a hose (not shown) connected to a source of the pressure medium (e.g. liquid), for example, of a refrigerating circuit of a vehicle conditioning arrangement. The pressure in the low pressure chamber 47 corresponds to that in the vane cells of the vane compressor.

The space between the stator 25, with the plates 38 and 40, and the closure constitutes a high-pressure chamber 36 of the vane compressor. The chamber 36 is connected with the interior 12 of the stator 25, by means of a coagulating filter 37 which separates the pressure medium from oil. The reference numeral 1 is used to designate an outlet from the high-pressure chamber (see FIG. 2).

It may be seen from FIG. 2 that the working chambers, located between the outer circumference of the rotor 15 and the inner circumference of the stator 25, have a somewhat crescent-shaped configuration. Each working chamber has a low-pressure section and a high-pressure section. The low pressure section of each working chamber communicates with the low-pressure chamber 47 in the base 46 by means of a low-pressure passage 10 in the stator 25. Each high-pressure section of the working chamber is connected through a conveying passage 16, which is provided with a plate valve 6, with a space bounded by a closure 7. This space is connected through a channel 8 to the coagulating filter 37, and hence to the high-pressure chamber 36.

The rotor 15 is provided with a plurality of throughgoing passages 14, which extend radially and outwardly relative to a longitudinal axis A of the rotor 15. Each passage 14 sealingly receives a vane 11, which has an outer end face directed towards the inner circumference of the stator 25 and an inner end face directed away from the inner circumference of the stator 25. The vanes 11 are shiftable radially in the respective passages 14 relative to the axis A. The outer end faces of the vanes 11 engage the inner cylindrical circumference of the stator 25 so as to divide the respective working chamber in the separable cells.

A shaft 17 is provided with an integrally connected thereto flange 17*a* which is received in the correrecess of the rotor 15. The shaft 17 is connected with conventional driving member (e.g. a motor) which is not shown for the sake of simplicity of the drawing. Concentrically with the rotor 15, there is provided an annular chamber 48 which is connected through a channel 21 with the high-pressure chamber 36. The channel 36 is rather narrow so that it functions as a throttle. It is also possible to arrange a separate throttle in the channel 36 so as to prevent the pressure medium flow from the high-pressure chamber 36 into the chamber 48. The inner end face of the passages 14 is open into the chamber 48. The pressure in the chamber 48 and in the inner end portions of the passage 14, which are sealingly closed from outside by the vanes 11, is equal to that in the high-pressure chamber 36.

The rotor 15 is provided with another throughgoing radial passage 41 which receives a valve 3, which is actuated in response to centrifugal force of a predetermined value. When the valve 3 is open the pressure medium is released from the chamber 48 and therefore from the inner end portion of the passage 14 into the low-pressure chamber 47 of the vane compressor. The valve 3 includes a hollow cylindrical sliding plug 34 slidably mounted in the passage 41. The plug 34 is movable between a closed position, in which it closes the passage 41 from the chamber 48 (see FIG. 1) and an open position in which it opens the passage 41 for communication through a passage 31 with the low-pressure chamber 47. A spring 33 is mounted with its one end on the plug 34 and with its other end it abuts a screw cap 32 so as to normally urge the plug 34 in the closed position. The channel 31 communicates with an annular groove 39 which is provided on the corresponding face surface of the end face plate 40. The annular groove 39 is connected with the low-pressure chamber 47 via a passage 30.

The vane compressor works as follows. During rotation of the rotor 15 in a direction X (see FIG. 2) the working chamber, including two adjacent cells separated from one another by the respective vanes, increases at first (low-pressure sector) and then decreases (high-pressure sector). During the increasing phase each cell of the working chamber is connected with the low-pressure passage 10, so that the pressure medium flows into the cells. Later, the cell separated by two vanes 11 decreases, so that the pressure medium in this cell is compressed. The compressed pressure medium flows through the plate valve 6 into the coagulating filter 37 and further into the high-pressure chamber 36. The oil separated from the pressure medium by the coagulating filter 37 is accumulated in the lower area of the high-pressure chamber 36 and flows through a channel (not shown) into the opening 10, in the interior 12 of the stator 25, in the chamber 48 and further into the passages 14. Thus, the oil lubricates all movable parts of the vane compressor.

The high pressure in the chamber 48—corresponding to that in the high pressure chamber 36—urges the vanes 11 radially and outwardly relative to the axis A into engagement with the inner circumference of the stator 25. During rotation of the rotor 15 each vane 11 is subjected to an additional pressure resulting from centrifugal force, which depends on the rotational speed (i.e. number of revolutions) of the vane compresor. Obviously, the sliding plug 34 of the valve is subjected to the same centrifugal force. As the rotational speed of the rotor increases, the centrifugal force increases, correspondingly. When the centrifugal force exceeds the biasing force of the spring 33, the plug 34 moves in the open position against the biasing force of the spring 33 until the passage 41 can communicate with the channel 31. A pressure medium may flow from the chamber 48 into the low-pressure chamber 47. Thus, the cumulative force acting on the inner end face of the vanes 11 decreases, correspondingly. The pressure in the chamber 48 is stipulated by the length and cross-sectional size of the channel 31. The vanes 11 are urged against the inner circumference of the stator 25 substantially only by the centrifugal force.

The weight of the slidable plug 34 is so big, that only when the rotational speed of the rotor gets to a predetermined level the sliding plug 34 starts to slide. It is to be noted that the pressure differential between the pressure on the side of the plug, which is directed towards the chamber 48 and the pressure on the opposite side of the plug should be maintained relatively small.

It is to be understood that there may be provided one or more such valves 3.

FIG. 3 shows another embodiment of the valve 3 shown in FIG. 1. The valve shown in FIG. 3 has considerably smaller weight than that shown in FIG. 1. Besides, the above-mentioned pressure differential surface in the embodiment shown in FIG. 3 is smaller than that in FIG. 1. In other respects the valve shown in FIG. 3 functions similar to that shown in FIG. 1.

It will be understood that each of the elements described above, or two or more together, may also find a useful application in other type of vane compressors differing from the types described above.

While the invention has been illustrated and described as embodied in a vane compressor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A vane compressor, comprising a hollow stator; a rotor received in said stator for rotation about an axis, said rotor being provided with a plurality of throughgoing passages extending radially and outwardly relative to said axis; a plurality of vanes, each received in one of said passages and having an outer end face directed towards an inner circumference of said stator and an inner end face directed away from said inner circumference of said stator, said vanes being shiftable radially in the respective passages relative to said axis; means for supplying pressure medium under a first pressure to said inner end faces of said vanes to thereby urge said vanes radially outwardly relative to said axis for engagement of said outer end faces with said inner circumference of said stator, said pressure medium supplying means including an annular chamber communicating with said inner end faces of said vanes; means forming a low-pressure chamber; means forming a high-pressure chamber operatively connected with said annular chamber so that pressure in said annular chamber is equal to that in said high-pressure chamber; means for rotating said rotor about said axis whereby said vanes are subjected to an additional second pressure resulting from centrifugal force, which second pressure additionally urges said vanes against the inner circumference of said stator, said first and second pressures together constituting a cumulative pressure which above a predetermined pressure level causes undesired frictional losses at the interfaces between said outer end faces of said vanes and the inner circumference of said stator; and means for decreasing said cumulative pressure at least slightly below said predetermined level to thereby eliminate said undesired frictional losses, said pressure decreasing means include means for connecting said annular chamber with said low-pressure chamber, said connecting means constituting a valve member movable in response to said cumulative pressure between a first position in which said annular chamber is disconnected from said low-pressure chamber and a second postion in which said annular chamber is connected with said low-pressure chamber for permitting the pressure medium flow from said annular chamber into said low-pressure chamber to thereby decrease said cumulative pressure urging said vanes into engagement with said inner circumference of said stator.

2. A compressor as defined in claim 1, wherein said rotor has an outer circumference sealingly contacting said inner circumference at least along one contacting line.

3. A compressor as defined in claim 2, wherein said outer circumference of said rotor constitutes together with said inner circumference of said stator at least one working chamber located between said inner and outer circumferences.

4. A compressor as defined in claim 3, wherein said vanes engaging said inner circumference of said stator sealingly divide said working chamber in a plurality of separate cells.

5. A compressor as defined in claim 1, and further comprising passage means for connecting said annular chamber with said low-pressure chamber, said valve member movable between said first position in which said passage means are closed so that no pressure medium cannot flow therethrough and said second position in which the pressure medium can flow from said annular chamber into said low-pressure chamber.

6. A compressor as defined in claim 5, and further comprising biasing means for urging said valve member into said first position.

7. A compressor as defined in claim 6, wherein said biasing means include a spring having two end portions spaced one from the other.

8. A compressor as defined in claim 7, and further comprising means for adjusting the biasing force of said biasing means to thereby regulate said biasing force.

9. A compressor as defined in claim 8, wherein said adjusting means include a screw cap operative for supporting one end portion of said spring, the other end portion of said spring abutting said valve member.

10. A compressor as defined in claim 7, wherein said valve member is a plug.

11. A compressor as defined in claim 10, wherein said rotor is provided with an additional throughgoing radially outwardly extending hole operative for sealingly receiving said plug.

12. A compressor as defined in claim 11, wherein said additional radial hole is closed from outside by a closing member operative for supporting one end of said spring.

13. A compressor as defined in claim 12, wherein said valve member is a hollow cylindrical plug.

* * * * *